US007464761B2

(12) United States Patent
Hosatte et al.

(10) Patent No.: US 7,464,761 B2
(45) Date of Patent: Dec. 16, 2008

(54) FLOW CONTROL SYSTEM FOR USE IN A WELL

(75) Inventors: Pierre Hosatte, Houston, TX (US); Thomas D. MacDougall, Sugar Land, TX (US); Stephane Hiron, Houston, TX (US); Michael J. Bertoja, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 396 days.

(21) Appl. No.: 11/306,881

(22) Filed: Jan. 13, 2006

(65) Prior Publication Data

US 2007/0163774 A1 Jul. 19, 2007

(51) Int. Cl.
*E21B 34/10* (2006.01)

(52) U.S. Cl. ..... 166/313; 166/66.6; 166/319; 166/375

(58) Field of Classification Search ..... 166/313, 166/375, 386, 66.6, 319
See application file for complete search history.

(56) References Cited

U.S. PATENT DOCUMENTS

| | | | |
|---|---|---|---|
| 4,660,647 | A | 4/1987 | Richart |
| 5,832,996 | A | 11/1998 | Carmody et al. |
| 5,906,238 | A | 5/1999 | Carmody |
| 6,012,518 | A | 1/2000 | Pringle et al. |
| 6,041,857 | A | 3/2000 | Carmody et al. |
| 6,102,828 | A | 8/2000 | MacKenzie |
| 6,109,357 | A | 8/2000 | Zimmerman |
| 6,125,938 | A | 10/2000 | Garcia-Soule et al. |
| 6,237,683 | B1 | 5/2001 | Pringle et al. |
| 6,247,536 | B1 | 6/2001 | Leismer et al. |
| 6,308,783 | B2 | 10/2001 | Pringle et al. |
| 6,502,640 | B2 | 1/2003 | Rayssiguier et al. |
| 6,505,684 | B2 | 1/2003 | Rayssiguier et al. |
| 6,523,613 | B2 | 2/2003 | Rayssiguier et al. |
| 6,536,530 | B2 | 3/2003 | Schultz et al. |
| 6,543,544 | B2 | 4/2003 | Schultz et al. |
| 6,575,237 | B2 | 6/2003 | Purkis et al. |
| 6,585,051 | B2 * | 7/2003 | Purkis et al. ..... 166/374 |
| 6,591,914 | B2 | 7/2003 | Williamson, Jr. |
| 6,612,547 | B2 | 9/2003 | Carmody et al. |

(Continued)

FOREIGN PATENT DOCUMENTS

| | | | |
|---|---|---|---|
| GB | 2392936 | A | 3/2004 |

(Continued)

OTHER PUBLICATIONS

V. B. Jackson & T. R. Tips, First Intelligent Completion System Installed in the Gulf of Mexico, SPE International, Sep. 4, 2001, SPE 71861, pp. 1-13.

*Primary Examiner*—Hoang Dang
(74) *Attorney, Agent, or Firm*—Jeremy P Welch; James L. Kurka; Robert A. Van Someren

(57) ABSTRACT

A technique is provided to control flow in a well. A well completion comprises one or more flow control valve systems coupled by an electric line and a hydraulic line. Each flow control valve system comprises a flow control valve responsive to hydraulic input via the hydraulic line and an electro-mechanical device. The electro-mechanical device is responsive to inputs via the electric line and is used to control hydraulic input to the corresponding flow control valve.

22 Claims, 12 Drawing Sheets

U.S. PATENT DOCUMENTS

| | | | | |
|---|---|---|---|---|
| 6,644,412 | B2 | 11/2003 | Bode et al. | |
| 6,668,936 | B2 | 12/2003 | Williamson, Jr. et al. | |
| 6,691,786 | B2 | 2/2004 | Patel | |
| 6,722,439 | B2 | 4/2004 | Garay et al. | |
| 6,736,213 | B2 | 5/2004 | Bussear et al. | |
| 6,913,240 | B1 | 7/2005 | MacKenzie | |
| 2002/0046845 | A1* | 4/2002 | Rayssiguier et al. | 166/375 |
| 2004/0069491 | A1 | 4/2004 | Garay et al. | |
| 2006/0196668 | A1* | 9/2006 | Burge et al. | 166/313 |
| 2006/0278399 | A1* | 12/2006 | Dwivedi et al. | 166/375 |

FOREIGN PATENT DOCUMENTS

| | | | |
|---|---|---|---|
| GB | 2401888 | A | 11/2004 |
| GB | 2402692 | A | 12/2004 |
| WO | 97/47852 | A1 | 12/1997 |
| WO | WO98/39547 | | 9/1998 |
| WO | 99/47788 | A1 | 9/1999 |
| WO | WO00/04274 | A1 | 1/2000 |

* cited by examiner

FLOW CONTROL SYSTEM FOR USE IN A WELL

BACKGROUND

Well completion equipment is used in a variety of well related applications involving, for example, the production of fluids. The completion equipment is deployed in a wellbore and often comprises one or more valves for controlling fluid flow in the well.

In some wells, it is desirable to control flow in several zones. Accordingly, downhole flow control valves are positioned in each of the zones and used, for example, to control the flow of fluid from the formation and surrounding wellbore into the completion.

Actuation of the valves is accomplished by several methods, including running multiple hydraulic control lines downhole and to each of the flow control valves. In other applications, hydraulic control lines can be combined with hydraulic multiplexers to direct hydraulic input to specific valves in specific zones. However, existing methods typically require several hydraulic control lines or a relatively high degree of complexity to control multiple valves in multiple well zones.

SUMMARY

In general, the present invention provides a system and method for controlling multiple flow control valves, each with a plurality of choke positions. The flow control valve system comprises a flow control valve having a variable choke that can be adjusted to a plurality of positions based on input from a single hydraulic line and an electrical line.

Depending on the application, additional flow control valves can be added, and each additional flow control valve is adjustable via the electrical line and single hydraulic line.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to well systems utilizing well completion equipment, including downhole well tools, such as flow control valves and mechanisms for actuating flow control valves. The system provides a methodology to facilitate multi-dropping a plurality of well zones with a limited number of control lines. Generally, electrical inputs are used to control electro-mechanical devices which, in turn, are used to control hydraulic input provided by a single hydraulic control line for selectively actuating a plurality of the flow control valves.

Figure 1:
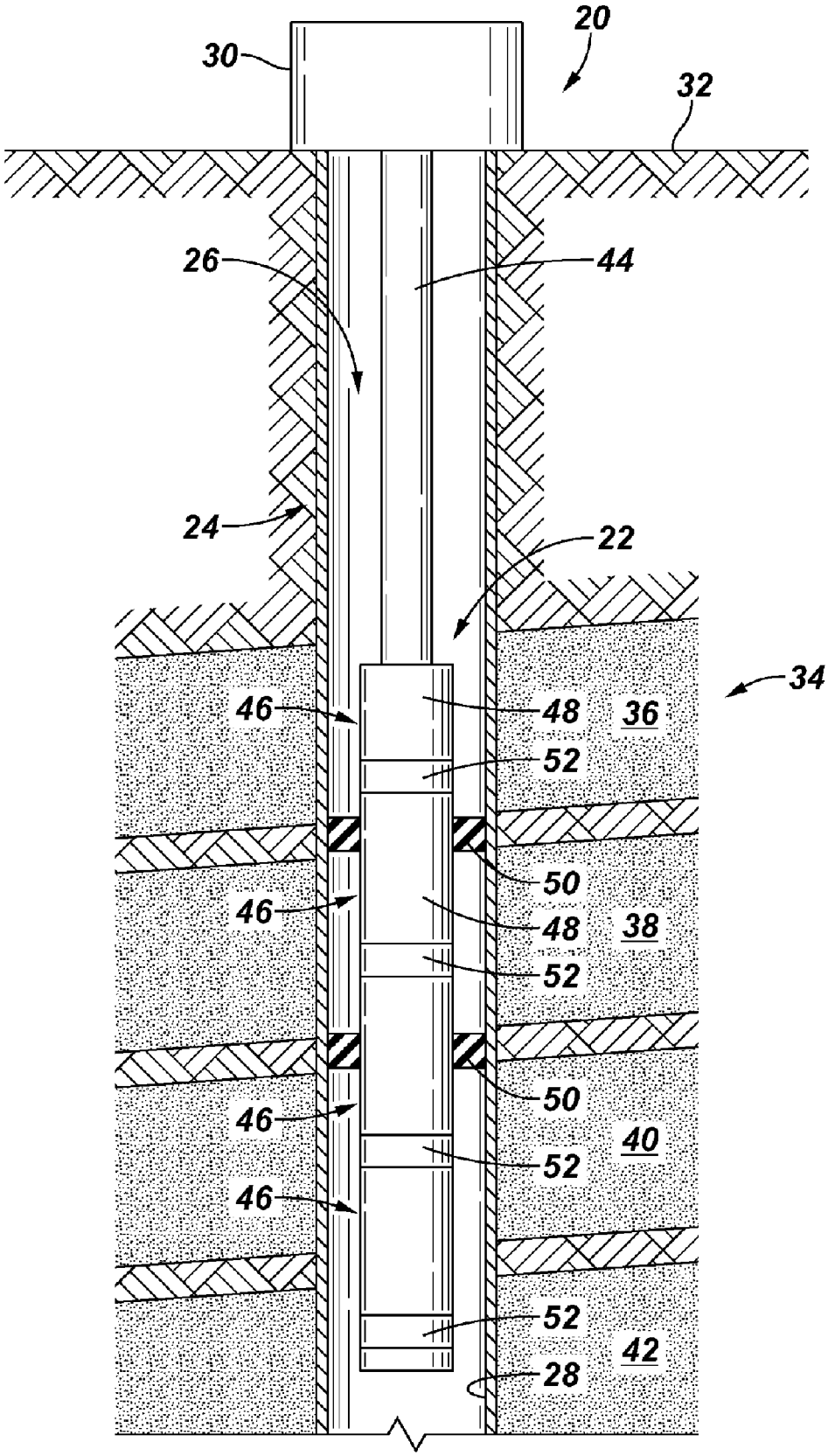
FIG. 1 is a front elevation view of a completion deployed in wellbore, according to an embodiment of the present invention.

Referring generally to FIG. 1, a well system 20 is illustrated as comprising a well completion 22 deployed for use in a well 24 having a wellbore 26 that may be lined with a wellbore casing 28. Completion 22 is deployed in wellbore 26 below a wellhead 30 disposed at a surface location 32, such as the surface of the Earth or a seabed floor. Wellbore 26 is formed, e.g. drilled, in a formation 34 that may contain, for example, desirable fluids, such as oil or gas. Formation 34 may comprise a plurality of well zones, e.g. zones 36, 38, 40 and 42.

Completion 22 is located within the interior of casing 28 and comprises a tubing 44 and a plurality of completion components 46. For example, well completion 22 may comprise pumping components 48 and one or more packers 50 to separate wellbore 26 into different zones, e.g. zones corresponding with well zones 36, 38, 40 and/or 42. Additionally, well completion 22 comprises at least one flow control valve system 52 and often a plurality of flow control valve systems 52 deployed at different locations along wellbore 26. In many applications, well system 20 comprises a plurality of flow control valve systems 52, such as at least three flow control valve systems 52 deployed at different locations to control flow of fluid to or from different well zones, e.g. flow of production fluid into wellbore 26 and through or along well completion 22 and tubing 44. In the specific embodiment illustrated, well system 20 has four flow control systems 52.

Figure 2:
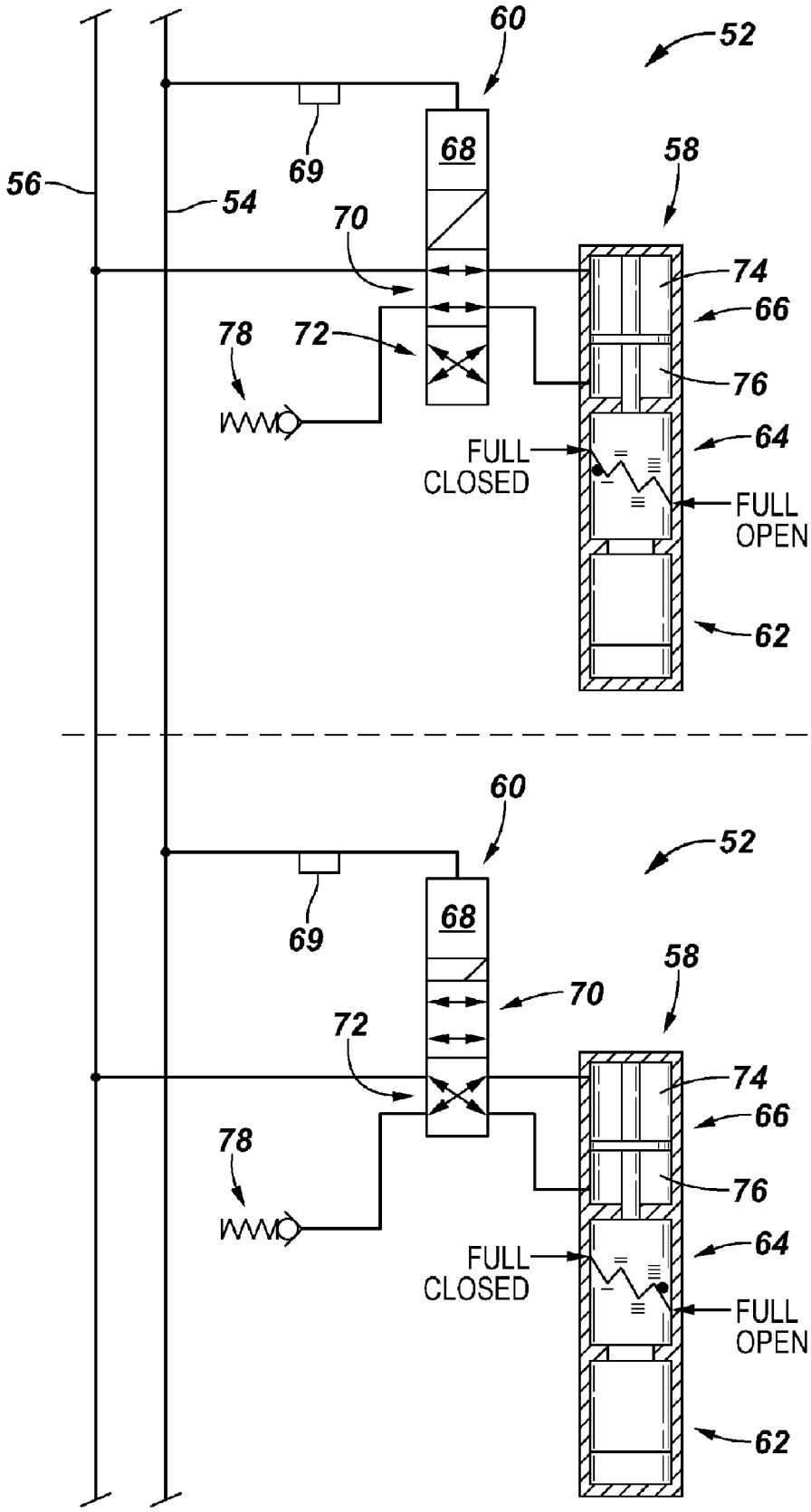
FIG. 2 is schematic illustration of a plurality of flow control valve systems coupled to an electric line and a hydraulic line, according to an embodiment of the present invention.

Referring generally to FIG. 2, a schematic embodiment of a plurality of flow control valve systems 52 is illustrated. In this example, two flow control valve systems 52 are coupled together to facilitate explanation of the ability to exercise control over a plurality of flow control systems with a limited number of control lines, namely a single electric line and a single hydraulic line. It should be noted, however, that additional flow control systems 52 can be added in a similar manner. The flow control valve systems 52 are placed at unique wellbore locations, such as locations corresponding to separate well zones.

As illustrated, the flow control valve systems 52 are controlled by an electric line 54 and a single fluid control, e.g. hydraulic, line 56. Each flow control valve system 52 comprises a flow control valve 58 and an electro-mechanical device 60 that controls flow of fluid, e.g. hydraulic fluid, between the single control line 56 and the flow control valve 58. The electromechanical device 60 is operated based on electrical inputs via electric line 54.

In the illustrated embodiment, each flow control valve 58 comprises a variable choke 62 that may be adjusted to a closed position, an open position, and at least one intermediate position therebetween. For example, each variable choke 62 may comprise a plurality of intermediate positions, e.g. four intermediate positions, as illustrated. Each flow control valve 58 further comprises a position adjustment mechanism, such as an indexer 64, coupled to variable choke 62 to sequentially adjust the variable choke between its closed and open positions. Additionally, each flow control valve 58 comprises a dual line actuator 66 that is coupled to indexer 64 and designed to reciprocate in response to hydraulic input for adjustment of indexer 64 to desired indexer settings.

In this example, each electro-mechanical device 60 comprises an electro-hydraulic servo valve, such as a linear drive, four-ways, two-positions directional servo valve. Device 60 may be built into the corresponding flow control valve 58. Device 60 comprises a motive unit 68 and a driver 69 that respond to electrical input via electric line 54 to adjust device 60, in this case an electro-hydraulic servo valve, to a first flow position 70 or a second flow position 72. For purposes of explanation, the first flow position 70 can be referred to as a straight flow position, and the second flow position 72 can be referred to as a cross-over flow position. When in first flow position 70, fluid from hydraulic line 56 flows into a chamber 74 on one side of dual line actuator 66 while an opposite chamber 76 on the other side of dual line actuator 66 is open to a vent outlet 78 that allows the control fluid to be vented, for example, to the wellbore annulus. (See upper flow control valve system 52 of FIG. 2). When motive unit 68 actuates device 60 to the second or cross-over flow position 72, fluid from hydraulic line 56 flows into an opposite side of dual line actuator 66, i.e. chamber 76. (See lower flow control valve system 52 of FIG. 2). In the latter cross-over flow configuration, chamber 74 of dual line actuator 66 is open to vent 78.

Accordingly, in operation, electro-mechanical device 60 is controlled electrically from, for example, surface 32 and effectively pilots the dual line actuator 66 of flow control valve 58 by selectively switching the flow of control fluid to either chamber 74 or chamber 76. The selection of first flow position 70 or second flow position 72 is accomplished by electrically commanding specific servo valves via electrical inputs through electric line 54. In this embodiment, hydraulic pressure from control line 56 is applied only once the pressure ports of device 60 are fully opened with respect to flow from control line 56. This prevents any seals within electro-mechanical device 60 from being exposed to the relatively high pressure exerted through line 56.

By applying pressure from control line 56 to selected chambers of dual line actuator 66, actuator 66 is able to reciprocate indexer 64 which creates hard-stops at discrete locations that correspond to specific choke positions of variable choke 62. Once a sequential choke position is reached, hydraulic pressure in actuator 66 is bled off, and the position of device 60 remains the same until the next actuation. When it is desired to move variable choke 62 to the next position, servo valve 60 is electrically switched again, and hydraulic pressure is applied to operate actuator 66 and move indexer 64/variable choke 62 to the next sequential position, as described above. If a second zone needs to be addressed, the flow control valve system 52 associated with the second zone is actuated in a similar fashion. The electro-mechanical device 60 of the flow control valve system associated with the second zone is actuated by unique electrical inputs to the specific device 60, while the devices 60 corresponding to other well zones remain in their same position. Hydraulic inputs through the same hydraulic line 56 are used to move the corresponding dual line actuator 66, indexer 64 and a variable choke 62. It should be noted that when control line 56 is pressurized, the nonactivated flow control valve systems 52 may be exposed to the pressure, but the indexer 64 of each of those systems prevents the corresponding variable choke from changing position.

Figure 3:
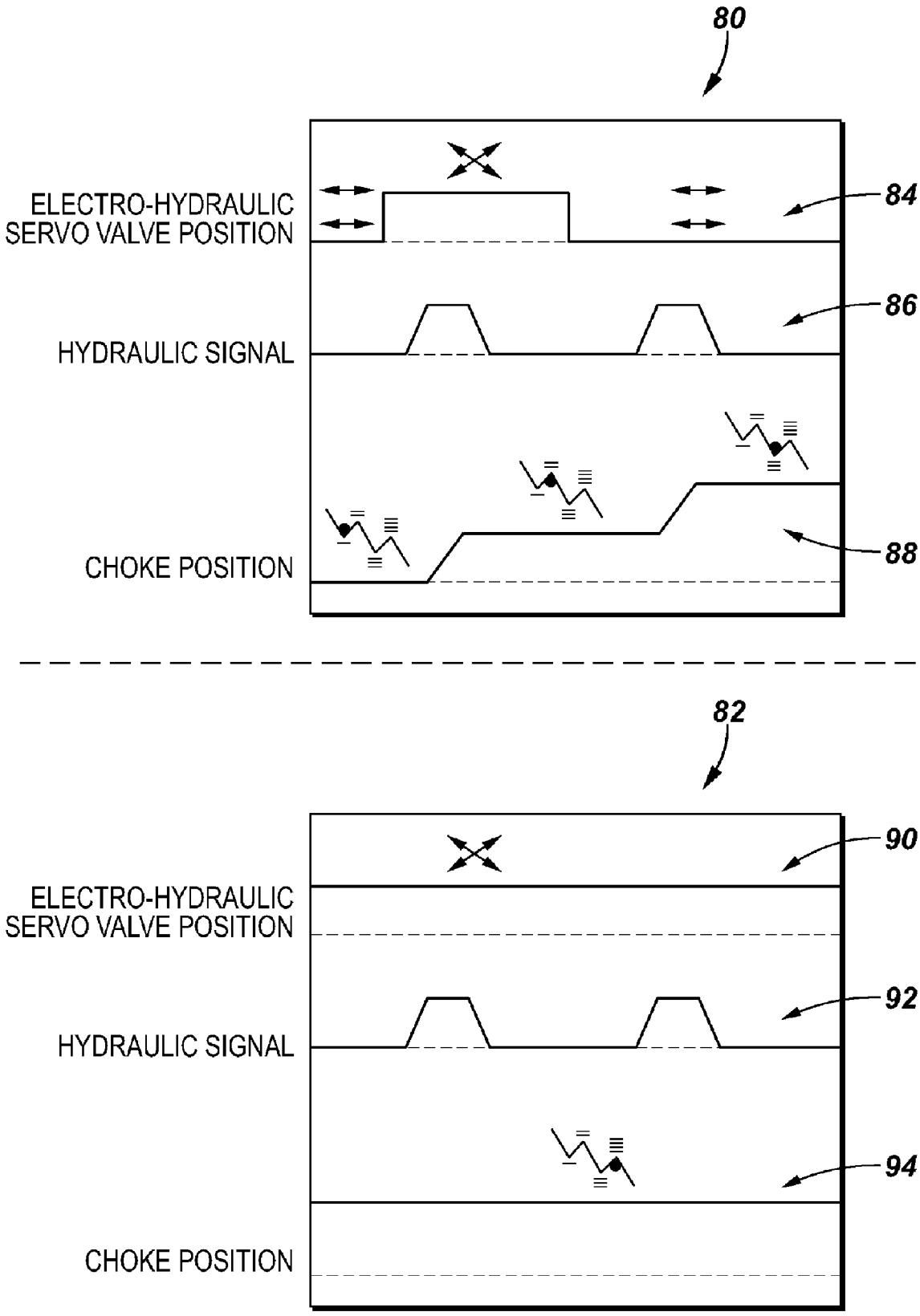
FIG. 3 is a graphical representation of actuation sequences for adjusting the flow control valves illustrated in FIG. 2 to unique flow positions, according to an embodiment of the present invention.

An example of adjusting individual flow control valve systems is illustrated graphically in FIG. 3. The upper graphical representation provides a functional diagram 80 that corresponds to the upper flow control valve system 52 of FIG. 2, and the lower graphical representation provides a functional diagram 82 that corresponds to the lower flow control valve system 52 of FIG. 2. As illustrated, the functional diagrams 80, 82 represent the sequence of inputs that move the upper flow control valve 58 from choke position number 1 to choke position number 3, while the lower flow control valve 58 remains in choke position number 4.

In functional diagram 80, the position of device 60, i.e. straight flow position 70 or cross-over flow position 72, is illustrated by a timeline 84, and the hydraulic signal, i.e. hydraulic line 56 pressurized or non-pressurized, is illustrated by timeline 86. Additionally, the corresponding choke position is provided by graph line 88. Functional diagram 82 has corresponding timelines 90 and 92 along with corresponding graph line 94 representing the choke position of the lower flow control valve 58.

Referring first to functional diagram 80, servo valve 60 is initially in a straight flow position 70. Subsequently, an electrical signal is input to the corresponding device 60 via electric line 54, causing motive unit 68 to shift servo valve 60 to the cross-over flow position 72. While in the cross-over flow position, control line 56 is pressurized, causing movement of dual line actuator 66 and indexer 64, thereby changing the choke position from position number 1 to position number 2. The pressure in control line 56 is then released, and subsequently an appropriate electrical signal is provided to servo valve 60 causing movement back to straight flow position 70. Pressure is then again applied via control line 56, thereby causing movement of actuator 66 in a reverse direction which transitions indexer 64 and variable choke 62 to choke position number 3, as illustrated. During the hydraulic and electrical inputs to the upper flow control valve system, servo valve 60 of the lower flow control valve system is set in cross-flow position 72. No further electrical inputs are provided to the lower servo valve to change its position, as illustrated by functional diagram 82. Accordingly, even though both flow control valve systems 52 are exposed to the same pressure signals (see timelines 86 and 92), the choke position of the lower indexer 64 and choke 62 remains at position number 4, as illustrated.

Figure 4:
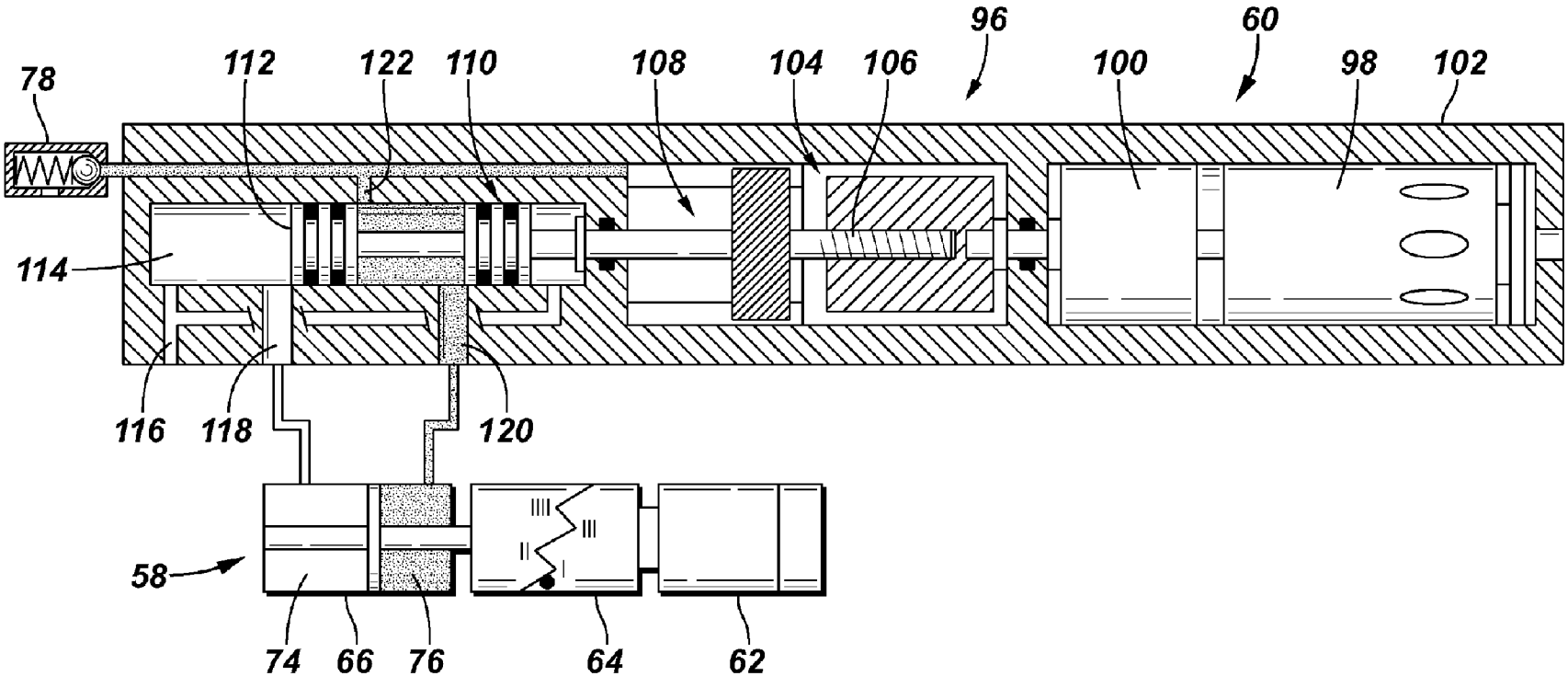
FIG. 4 is a cross-sectional view of an electro-mechanical device coupled to a flow control valve, according to an embodiment of the present invention.

A variety of electro-mechanical devices 60 can be designed to control fluid flow between control line 56 and flow control valve 58. In FIG. 4, an embodiment of device 60 is illustrated as a servo valve 96 and specifically as a linear drive directional servo valve. In this embodiment, the motive unit 68 of servo valve 96 comprises a drive motor 98 coupled to a gearbox 100 within a housing 102. Upon electrical input from electric line 54, motor 98 rotates gearbox 100 which, in turn, drives a lead screw mechanism 104 that converts the rotational motion of motor 98 into linear motion. Lead screw mechanism 104 has a lead screw 106 that drives a linear movement member 108 coupled to a spool valve 110. In this particular design, the spool valve 110 is a balanced design to reduce the amount of power required to actuate and switch the servo valve between first flow position 70 and second flow position 72. Also, equalization pressure is reduced to a differential between the hydrostatic head and the formation pressure because the spool valve is actuated only while the pressure in the control line 56 is bled down.

As illustrated, spool valve 110 comprises a spool 112 slidably mounted within a spool cavity 114. Spool cavity 114 is communicatively coupled with control line 56 via a port 116 and with actuator 66 via ports 118 and 120. Additionally, spool cavity 114 has a bleed port 122 through which internal fluid can be bled from spool cavity 114 to vent 78.

Figure 5:
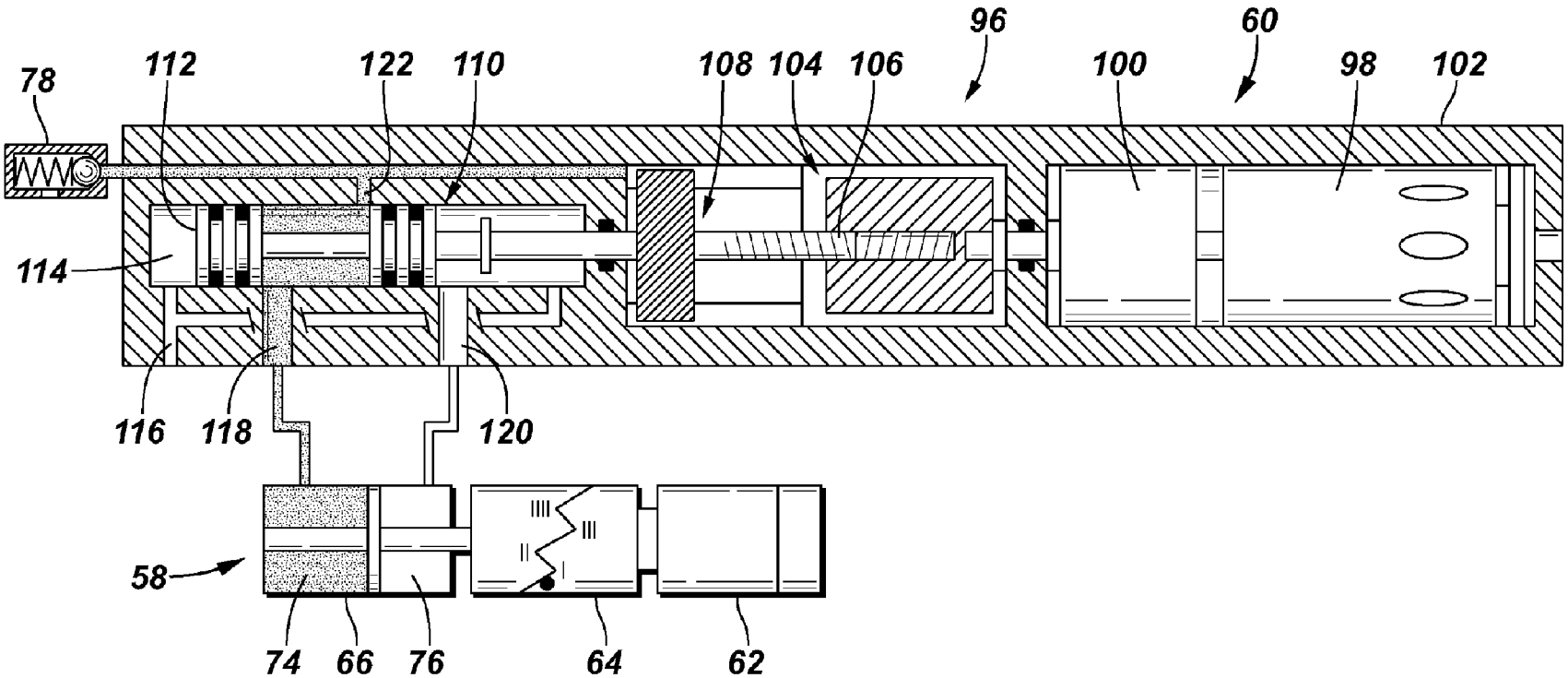
FIG. 5 is a view similar to that in FIG. 4, but showing the electro-mechanical device at a different state of actuation, according to an embodiment of the present invention.
Figure 6:
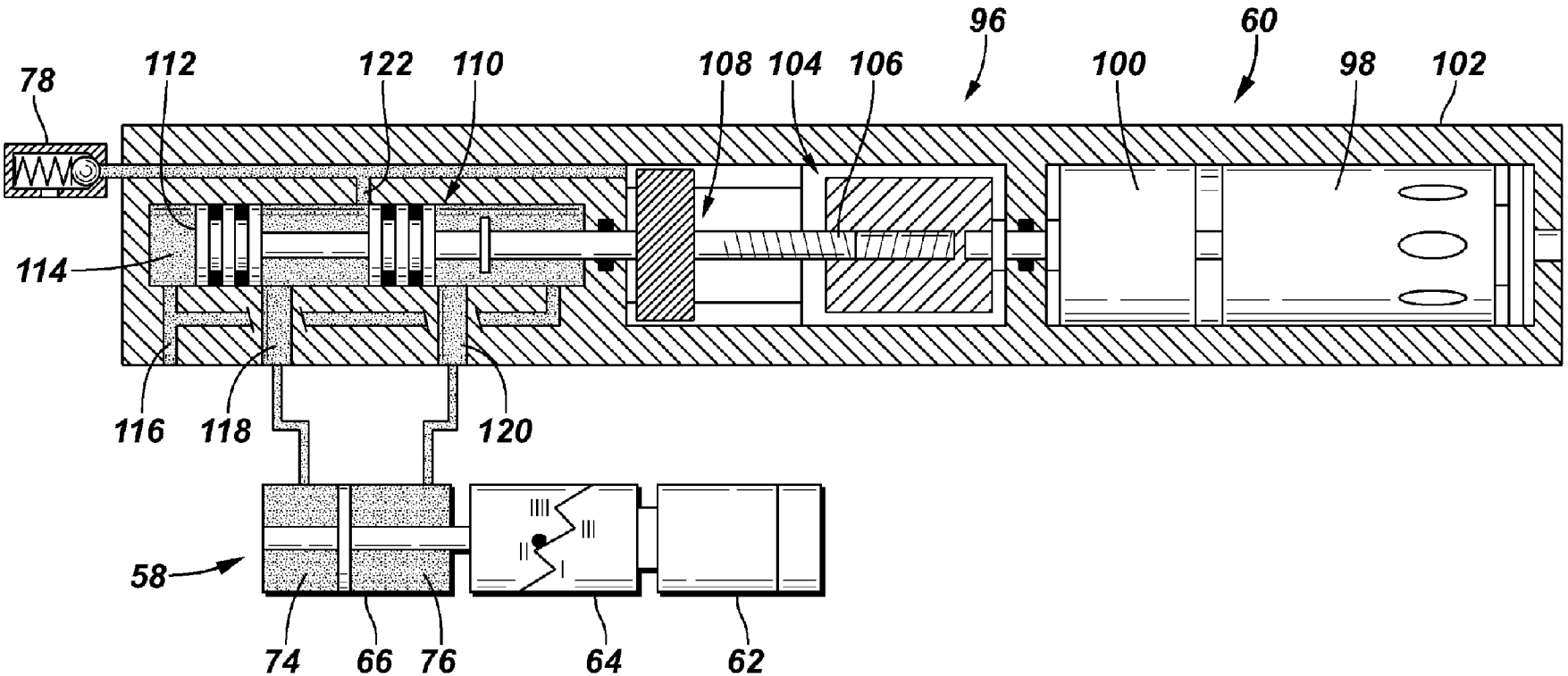
FIG. 6 is a view similar to that in FIG. 4, but showing the electro-mechanical device at another state of actuation, according to an embodiment of the present invention.
Figure 7:
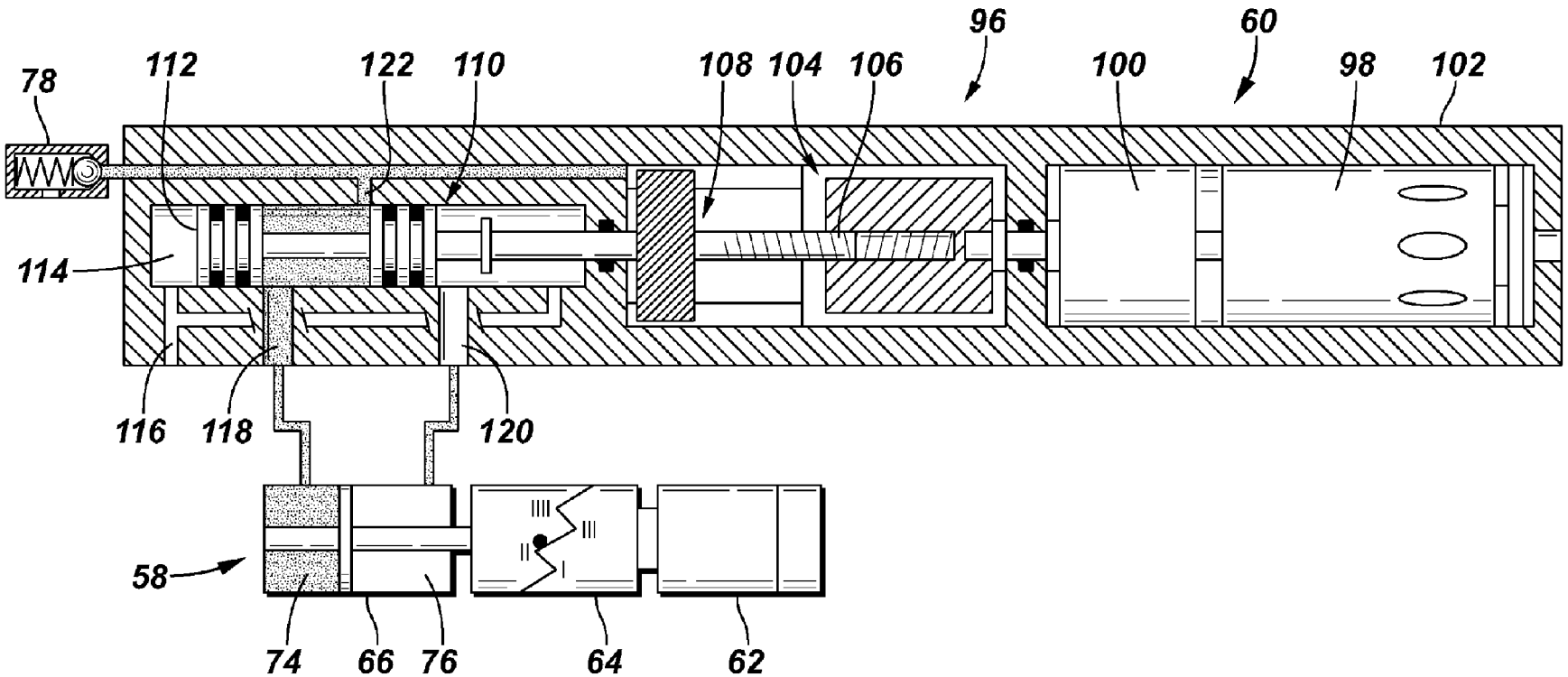
FIG. 7 is a view similar to that in FIG. 4, but showing the electro-mechanical device at a another state of actuation, according to an embodiment of the present invention.

With additional reference to FIGS. 5 through 7, a sequence of electric and hydraulic inputs for moving variable choke 62 and indexer 64 from one choke position to another can be explained. In this particular example, the variable choke 62 and indexer 64 are moved from choke position number 1 to choke position number 2, as illustrated.

Referring first to FIG. 4, surface pressure, i.e. pressure in control line 56, is bled off via release of pressure in the control line and/or through vent 78. Spool valve 110 is located in the first or straight flow position 70. At this point in time, indexer 64 and variable choke 62 are set at choke position number 1. Subsequently, an electric command signal is provided via electric line 54 while any pressure in control line 56 is still bled off. The electric command signal initiates operation of motor 98 and movement of spool 112 to the second or cross-over flow position 72, as illustrated in FIG. 5. When spool valve 110 is in this cross-over flow position, hydraulic pressure is applied to port 116 via control line 56, as illustrated in FIG. 6. The pressurized fluid flows out through port 120 and into chamber 76 to actuate dual line actuator 66, thereby moving indexer 64 and variable choke 62 to choke position number 2. Once variable choke 62 is adjusted to the new position, pressure applied via control line 56 is released, and spool valve 110 remains in the cross-over flow position 72. Each time flow control valve 58 is adjusted to a new choke position, an appropriate series of electrical and hydraulic inputs can be provided, similar to that described above.

Figure 8:
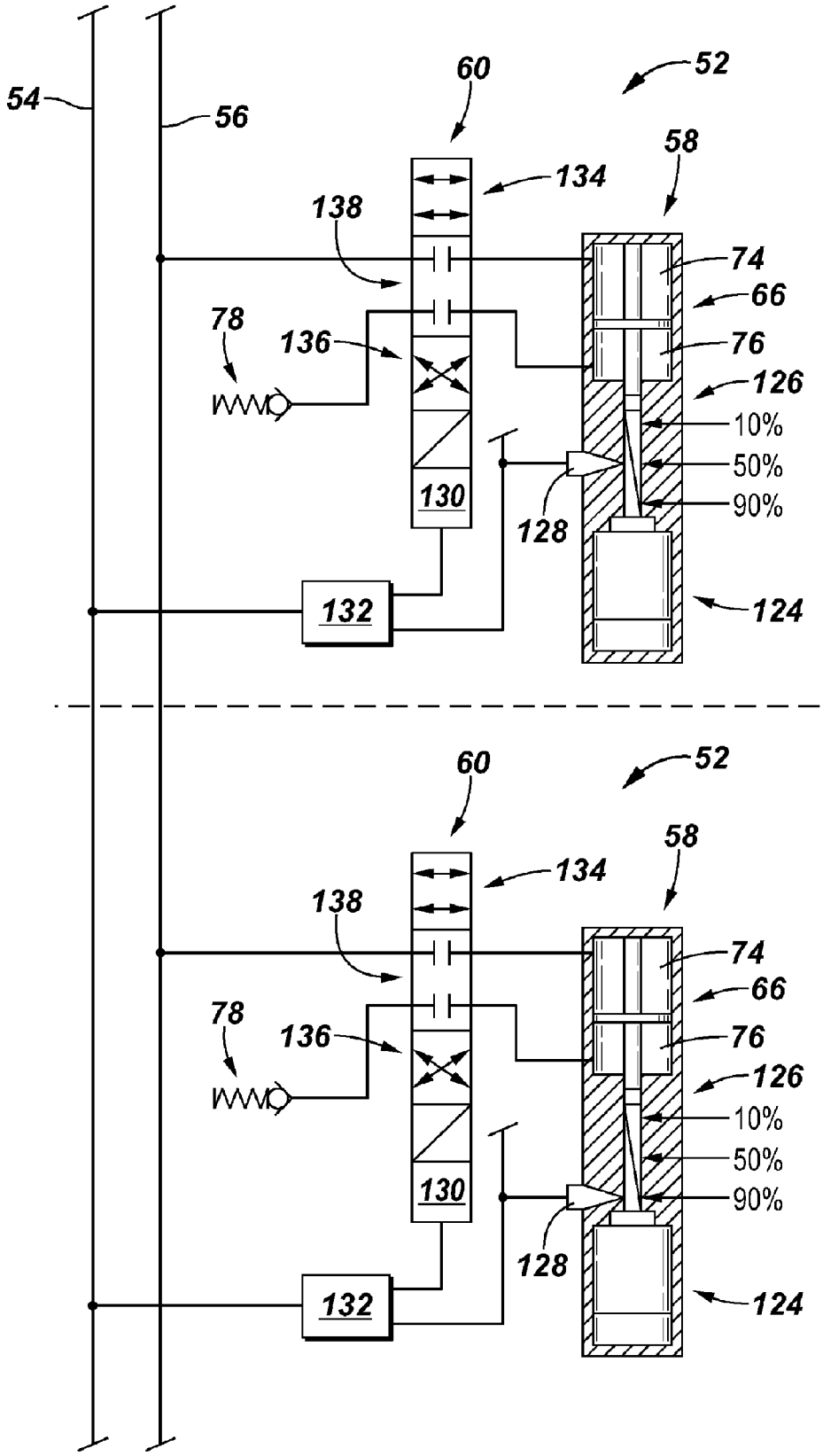
FIG. 8 is schematic illustration of a plurality of flow control valve systems coupled to an electric line and a hydraulic line, according to an alternate embodiment of the present invention.

Referring generally to FIGS. 8-12, an alternate embodiment of the well system is illustrated in which one or more of the flow control valve systems has a continuously, i.e. infinitely, variable choking capability. For purposes of explanation, a schematic embodiment of a plurality of flow control valve systems 52 is illustrated in FIG. 8. In this alternate embodiment, two flow control valve systems are again illustrated to facilitate explanation of the capability for exercising control over a plurality of flow control systems with an electric line and a single fluid, e.g. hydraulic, control line. However, additional flow control systems 52 can be placed at additional wellbore locations.

In this embodiment, each flow control valve system 52 again comprises the flow control valve 58 and the electro-mechanical device 60. Electro-mechanical device 60 controls flow of fluid between the single fluid control line 56 and the flow control valve 58 based on the electrical inputs via electric line 54. However, various components of both flow control valve 58 and electro-mechanical device 60 have been changed relative to the embodiment described with reference to FIGS. 2-7.

As illustrated, each flow control valve 58 comprises a choke 124 that is continuously or infinitely variable between a closed position and a fully open position. Each flow control valve 58 further comprises a position adjustment mechanism in the form of an electrical position transducer 126 coupled to the corresponding infinitely variable choke 124. The electrical position transducer 126 may comprise a position detector 128 able to provide continuous feedback to a control system regarding the actual position of infinitely variable choke 124. Thus, choke 124 can be accurately set at any position from closed to fully open. Additionally, each flow control valve 58 comprises dual line actuator 66 coupled to electric position transducer 126 and designed to move the position transducer 126 and choke 124 in response to hydraulic input, as described above with respect to the embodiment illustrated in FIGS. 2-7.

In this embodiment, each electromechanical device 60 may comprise a hydraulic servo valve in the form of a four-way, three-position servo valve. Again, device 60 may be a separate device or built into a corresponding flow control valve 58. Device 60 comprises a motive unit 130 that responds to an electrical input from electric line 54 sent through a controller/PID corrector 132. It should be noted that position detector 128 can be coupled to controller 132 to provide feedback to controller 132 regarding the position of choke 124. Motive unit 130 adjusts device 60, e.g. a servo valve, to one of three positions, namely a first flow position 134, a second flow position 136, and a third position which is a closed or no-flow position 138. When in the first, flow position 134, fluid from hydraulic line 56 flows into chamber 74 of dual line actuator 66 while the opposite chamber 76 is open to vent outlet 78. When motive unit 130 actuates device 60 to the second flow position 136, fluid from hydraulic line 56 flows into chamber 76 of dual line actuator 66, and chamber 74 is open to vent 78. When motive unit 130 actuates device 60 to the third, closed position 138, the volume of control fluid in chambers 74 and 76 is fixed or locked, preventing movement of dual line actuator 66 and choke 124.

By applying pressure from control line 56 to selected chambers 74 or 76 of dual line actuator 66, the actuator is able to move the electrical position transducer 126 and the infinitely variable choke 124 to any desired choke position. The electrical position transducer 126 is able to provide feedback as to the actual position of choke 124, thus enabling a well operator precise control over the positioning of each individual choke.

Figure 9:
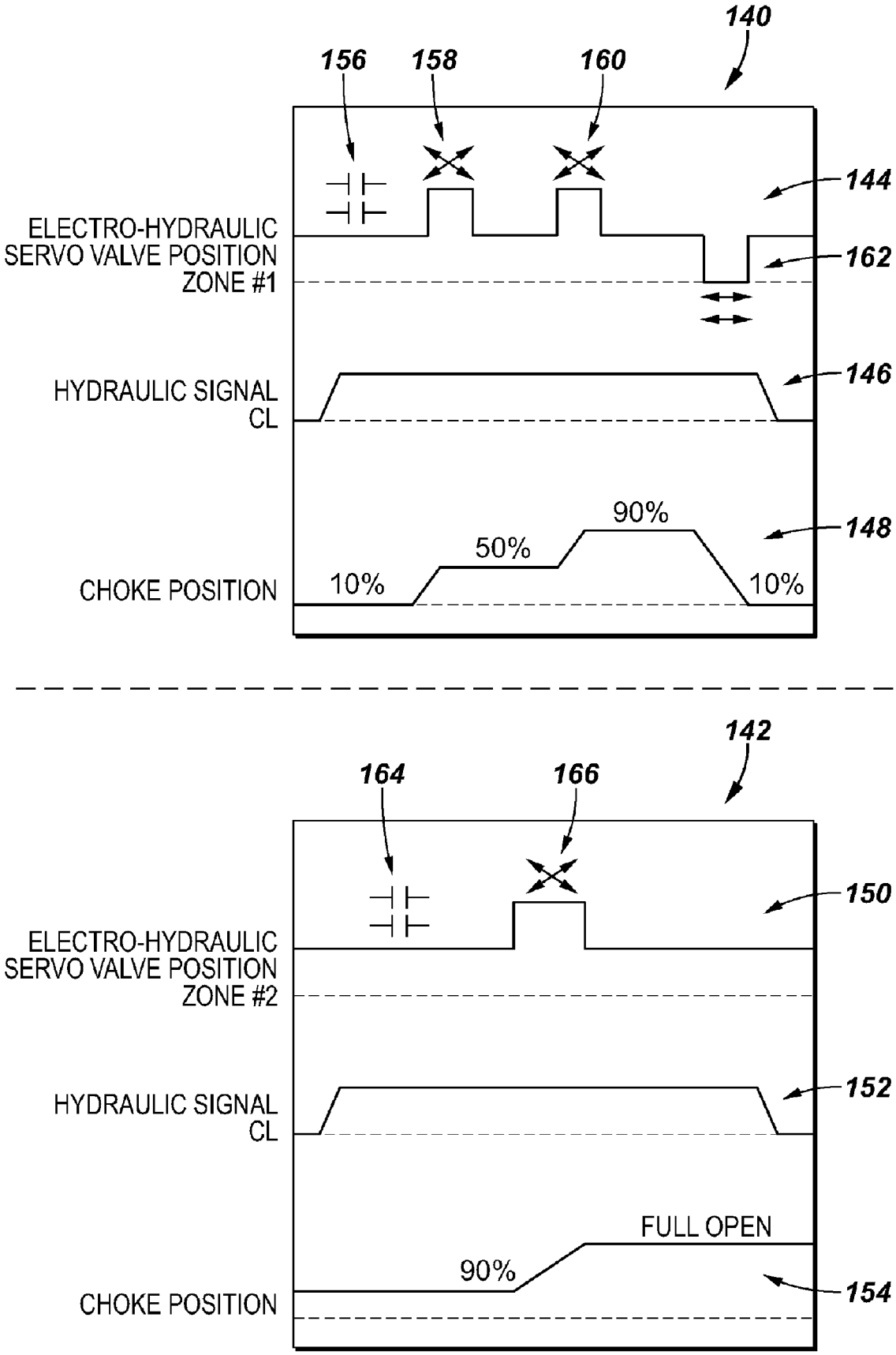
FIG. 9 is a graphical representation of actuation sequences for adjusting the flow control valves illustrated in FIG. 8 to unique flow positions, according to an alternate embodiment of the present invention.

A schematic example of adjusting the individual flow control valve systems is illustrated in FIG. 9. The upper graphical representation provides a functional diagram 140 that corresponds to the upper flow control valve system 52 of FIG. 8, and the lower graphical representation provides a functional diagram 142 that corresponds to the lower flow control valve system 52 of FIG. 8. The functional diagrams 140, 142 represent the sequence of inputs through electric line 54 and hydraulic line 56 that are responsible for actuating each device 60 and each corresponding flow control valve 58 to move the corresponding choke 124 to a desired position.

In functional diagram 140, the position of electro-mechanical device 60 is illustrated by a timeline 144. The fluid, e.g. hydraulic, signal in control line 56 is illustrated by a timeline 146 as either pressurized or non-pressurized. Additionally, the corresponding position of choke 124 is provided by a graph line 148. Functional diagram 142 has corresponding timelines 150 and 152 along with corresponding graph line 154 representing the choke position of the lower flow control valve 58.

Referring to functional diagram 140, the servo valve device 60 is initially in a closed flow position 138, as indicated by segment 156 of timeline 144. While in this position, control line 56 is pressurized, as indicated by timeline 146. Subsequently, an electric signal is input to the corresponding device 60 via electric line 54, causing motive unit 130 to shift the servo valve 60 to the second flow position 136, as indicated by segment 158 of timeline 144. While in the second flow position, the pressure in control line 56 causes actuation of dual line actuator 66 and movement of electrical position transducer 126, thereby changing the opening of choke 124, as indicated by graph line 148. An electric signal to servo valve 60 then returns the servo valve to the closed position 138 until a subsequent electric signal once again moves device 60 to the second flow position 136, as indicated by segment 160 of timeline 144. During this time, pressure has been maintained in control line 56 which causes movement of dual line actuator 66 and electrical position transducer 126 to further change the opening of choke 124 in the same direction, as indicated by graph line 148. Subsequently, servo valve 60 is returned to the closed, no-flow position 138 to hold the choke position until further adjustment of the choke. By way of example, the choke 124 may be adjusted again through actuation of device 60 to the first flow position 134, as indicated by segment 162. In first flow position 134, the maintained pressure in control line 56 moves dual line actuator 66 and electrical position transducer 126 in an opposite direction until choke 124 arrives at a desired choke position, as again indicated by graph line 148. Position detector 128 provides feedback to enable the precise amount of opening or closing of choke 124 as desired by the well operator. Each time the choke 124 is moved to a desired choking position, the servo valve is moved back to its closed flow position 138 which isolates actuator 66 from both control line 56 and the formation environment, thus locking the choke at the desired position.

During the hydraulic and electrical inputs to the upper flow control valve system, the same hydraulic pressure is maintained with respect to the lower flow control system, as indicated by timeline 152. However, different electrical inputs can be provided to the servo valve 60 of the lower flow control system. In this example, the lower choke 124 is initially at a 90% position, and the lower servo valve 60 is in a closed, no-flow position 138 as indicated by segment 164 on timeline 150. Subsequently, an electrical input is provided to the lower device 60 shifting it to a second flow position, as indicated by segment 166 of timeline 150. The servo valve is maintained in this position a sufficient length of time such that the hydraulic pressure from control line 56 is able to move the lower dual line actuator 66 and electrical position transducer 126 until the lower choke 124 is opened the desired amount, as indicated by graph line 154. Thus, with electrical line 54 and a single hydraulic line 56, the chokes 124 can be independently controlled to infinitely variable positions.

Figure 10:
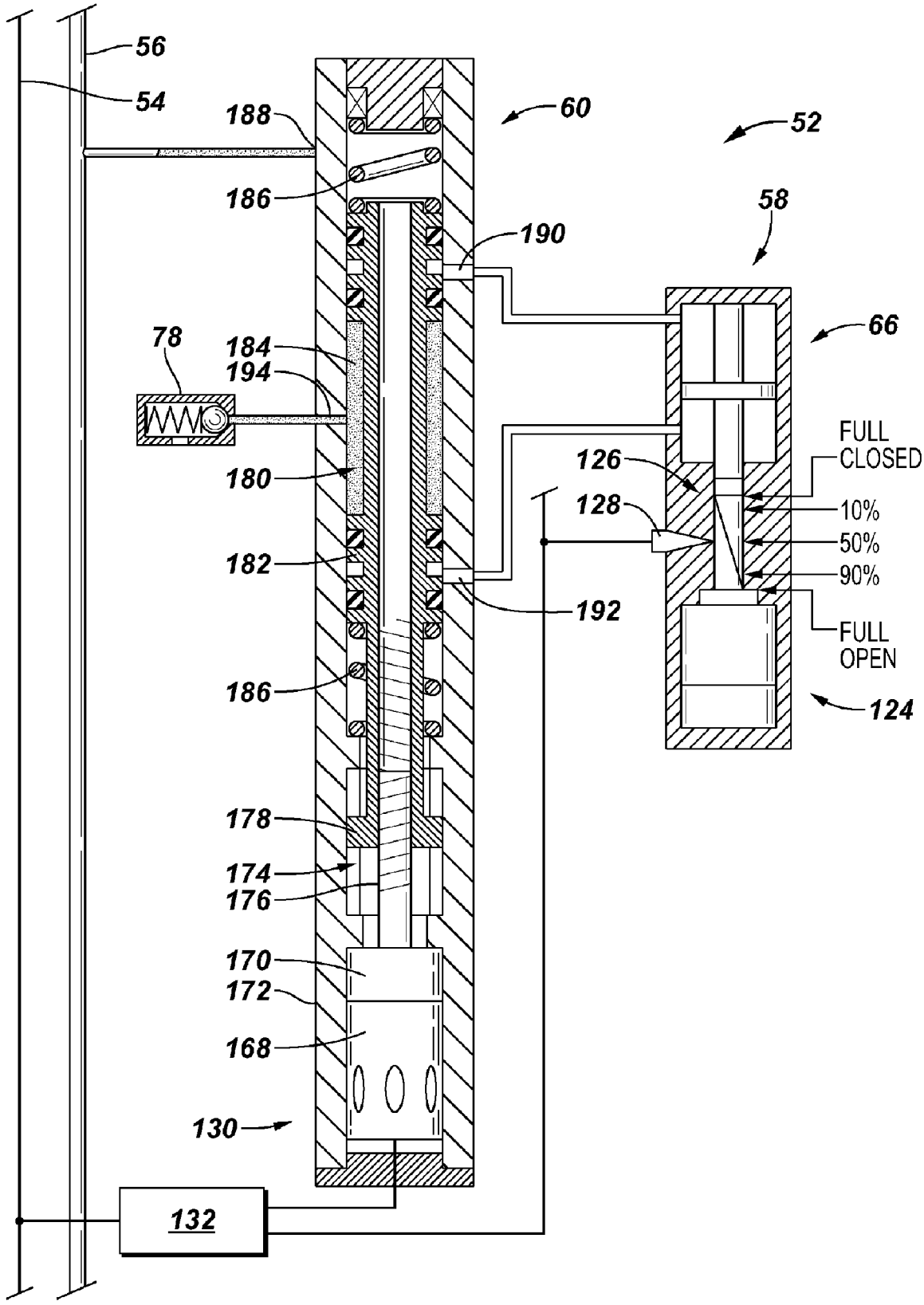
FIG. 10 is a cross-sectional view of an electro-mechanical device coupled to a flow control valve, according to an alternate embodiment of the present invention.
Figure 11:
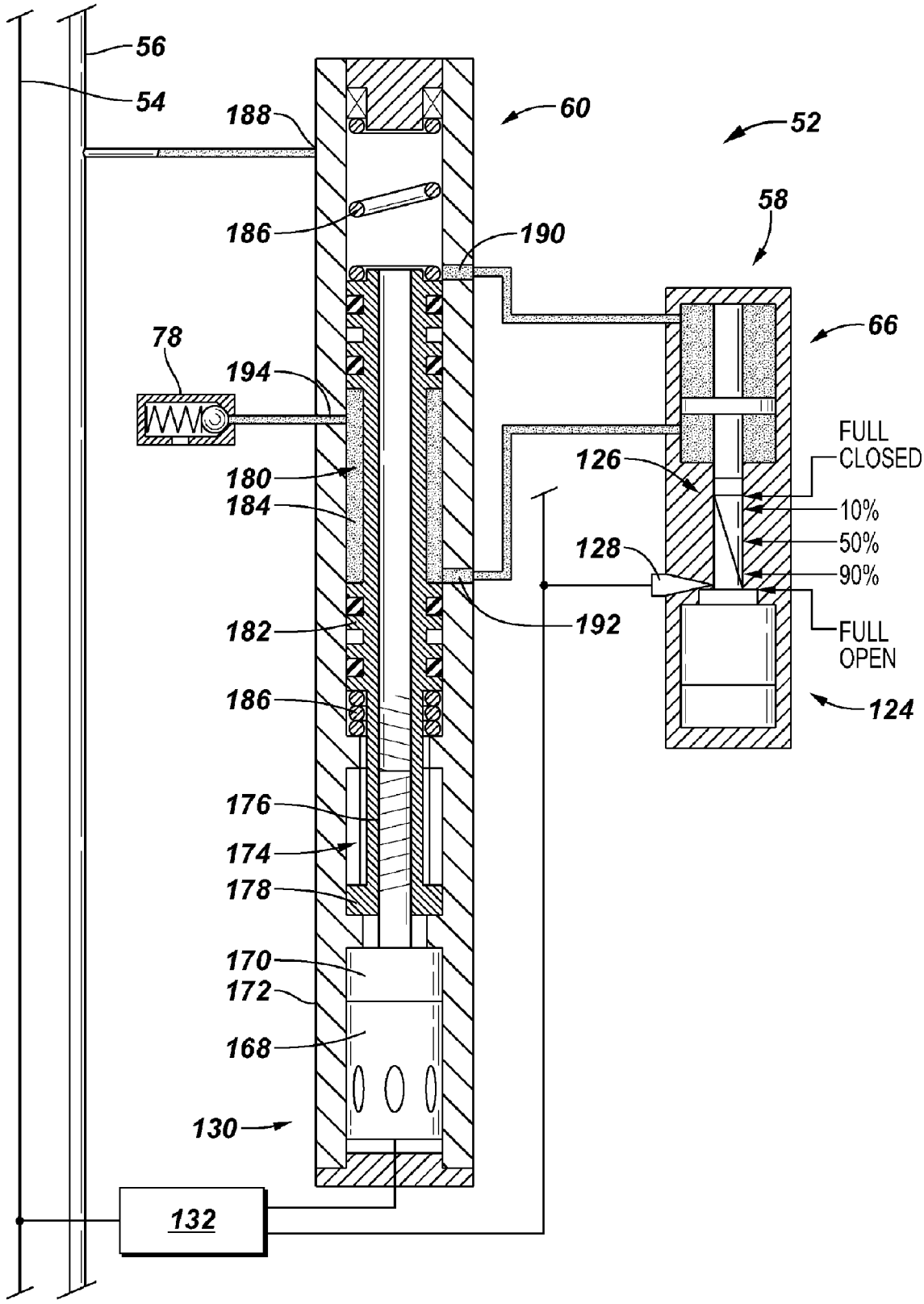
FIG. 11 is a view similar to that in FIG. 10, but showing the electro-mechanical device at a different state of actuation, according to an alternate embodiment of the present invention.
Figure 12:
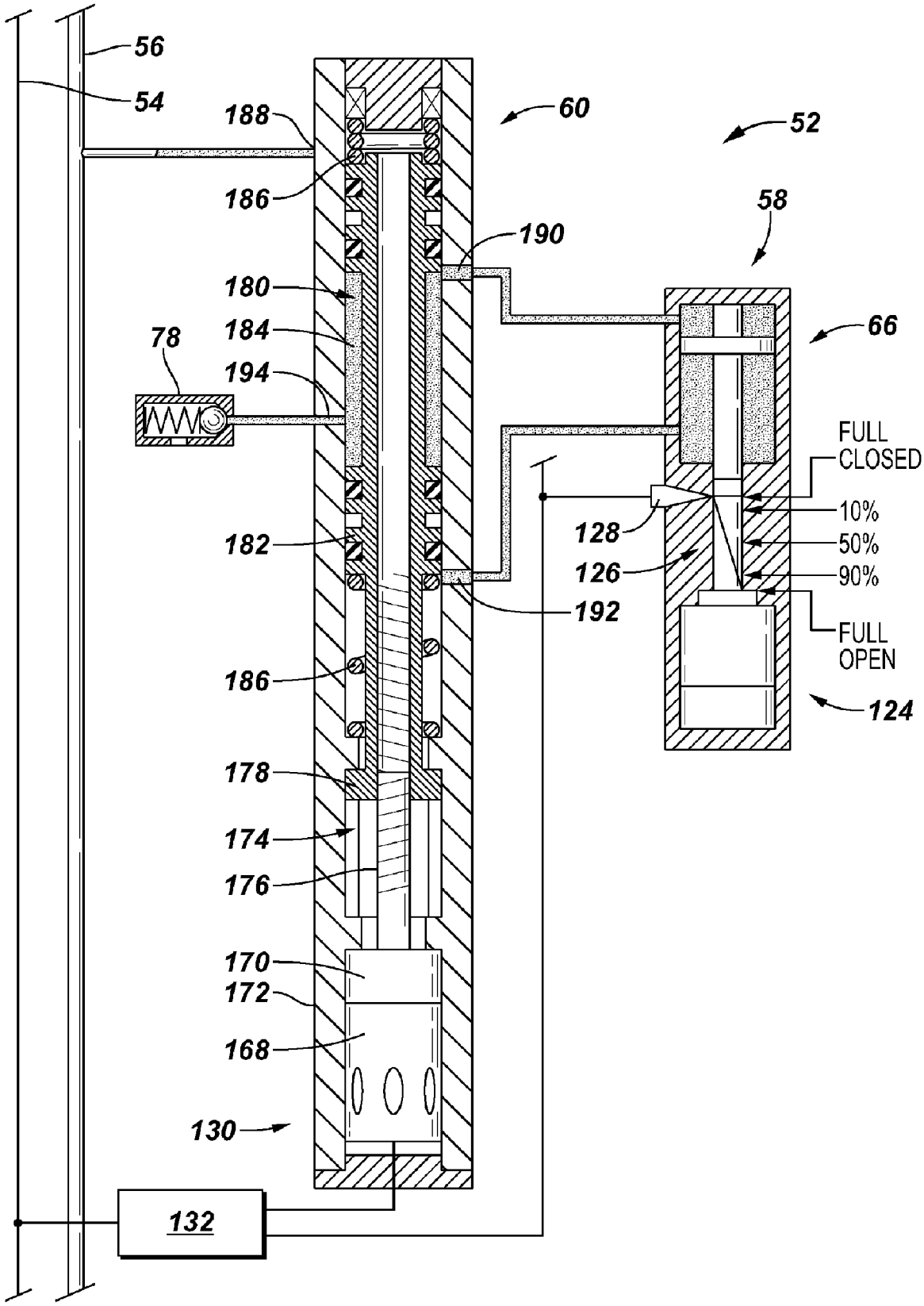
FIG. 12 is a view similar to that in FIG. 10, but showing the electro-mechanical device at another state of actuation, according to an alternate embodiment of the present invention.

In this embodiment, the electromechanical devices 60 can be designed as four-way, three-position servo valves, as illustrated in FIGS. 10-12. In FIG. 10, the motive unit 130 of servo device 60 comprises a drive motor 168 coupled to a gearbox 170 within a housing 172. Upon electrical input from electric line 54, drive motor 168 rotates gearbox 170 which drives a lead screw mechanism 174 to convert the rotational motion of drive motor 168 into linear motion. Lead screw mechanism 174 comprises a lead screw 176 that drives a linear movement member 178 to form a direct drive pilot mechanism for linearly adjusting a spool valve 180.

As illustrated, spool valve 180 comprises a spool 182 slidably mounted within a spool cavity 184. The spool 182 may be mounted between spring members 186 which tend to bias the spool toward a centralized closed flow position. Spool cavity 184 is communicatively coupled with control line 56 via a port 188 and with actuator 66 via ports 190 and 192. Additionally, spool cavity 184 has a bleed port 194 through which an internal fluid can be bled from spool cavity 184 to vent 78. In FIG. 10, spool 182 is positioned in the closed flow position 138 to block flow through ports 190 and 192. To adjust the position of choke 124, pressure is applied in control line 56. Also, spool 182 is shifted by motive unit 130 to enable pressurized flow through either port 190 or port 192 to move choke 124 in one direction or the other.

As illustrated in FIG. 11, an appropriate electrical input to motive unit 130 via electrical line 54 actuates drive motor 168 and moves spool 182 to expose port 190. This enables the flow of pressurized fluid from control line 56 through spool chamber 184 and out through port 190 to dual line actuator 66. The pressurized fluid drives dual line actuator 66 and electrical position transducer 126 in a first direction to adjust choke 124. When the choke has been adjusted a desired amount, spool 182 is returned to its closed or no-flow position, as illustrated in FIG. 10.

When it is desired to move choke 124 in an opposite direction, an appropriate electrical signal is supplied to motive unit 130 via electric line 54 to shift the spool 182 in an opposite direction, as illustrated in FIG. 12. This enables the flow of pressurized fluid from control line 56 through spool chamber 184 and out through port 192 to dual line actuator 66. The pressurized fluid drives dual line actuator 66 and electrical position transducer 126 in an opposite direction to adjust choke 124 back a desired amount. When the choke has been sufficiently adjusted, spool 182 is again returned to its closed or no-flow position, as illustrated in FIG. 10. The spool 182 is thus selectively movable to either of the flow positions and to the closed position to provide infinite adjustability of choke 124.

The ability to use electric input to control the flow of pressurized fluid through a control line provides the overall system with great flexibility for integration into a variety of well applications, including intelligent completion applications and reservoir modeling integration. The use of separate electric commands and fluid, e.g. hydraulic, commands via a single control line, enables a well operator to readily isolate and/or optimize flow rates from specific well zones at specific periods of time.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A well system, comprising:

a well completion comprising a plurality of flow control valve systems coupled by an electric line and a single hydraulic line, each flow control valve system having at least three choke positions, wherein the unique selection of choke positions may be controlled for each flow control valve system solely through inputs via the electric line and the single hydraulic line, each flow control valve system being individually controllable completely independently of the other flow control valve systems.

2. The well system as recited in claim 1, wherein each flow control valve system comprises a flow control valve that may be hydraulically actuated.

3. The well system as recited in claim 2, wherein each flow control valve system comprises an electro-mechanical device that controls flow of hydraulic fluid between the single hydraulic line and the flow control valve.

4. The well system as recited in claim 3, wherein the flow control valve comprises a variable choke.

5. The well system as recited in claim 4, wherein the flow control valve comprises an indexer coupled to the variable choke.

6. The well system as recited in claim 3, wherein the flow control valve comprises an infinitely variable choke and an electrical position transducer coupled to the infinitely variable choke.

7. The well system as recited in claim 3, wherein the electro-mechanical device comprises a four-way, multi-position directional servo valve.

8. A method of controlling flow at a plurality of locations along a wellbore; comprising deploying a plurality of variable choke position, flow control valve systems along a wellbore completion;

connecting the plurality of variable choke position, flow control valve systems with a single hydraulic line and an electric control line;

coupling a servo valve into each variable choke position, flow control valve, the servo valve being movable between a plurality of operational positions to direct fluid flow from the single hydraulic line;

selectively providing a pressure signal through the single hydraulic line at each operational position of the servo valve; and adjusting individual variable choke position, flow control valve systems to selected choke positions solely with the pressure signals from the single hydraulic line and the electric control line.

9. The method as recited in claim 8, wherein deploying comprises deploying at least three variable choke position, flow control valve systems.

10. The method as recited in claim 8, wherein connecting comprises connecting the electric control line to a plurality of servo valves, each servo valve being coupled into a corresponding variable choke position, flow control valve system.

11. A valve system for use in a well, comprising:

a plurality of flow control valves, each having a variable choke, a position adjustment mechanism to set the variable choke at selected positions, and a dual line actuator to adjust the position adjustment mechanism to a desired position; and a plurality of electro-hydraulic servo valves coupled to a single hydraulic line and an electric line, wherein electrical input via the electric line enables selective adjustment of electro-hydraulic servo valves to a first position, such that hydraulic input from the single hydraulic line moves the dual line actuator of a corresponding flow control valve in a first direction, and to a second position, such that hydraulic input from the single hydraulic line moves the dual line actuator in a second direction, wherein uniquely timed pressure pulses delivered through the single hydraulic line enable individual control over the actuation of each flow control valve.

12. The valve system as recited in claim 11, wherein the position adjustment mechanism comprises an indexer.

13. The valve system as recited in claim 11, wherein the position adjustment mechanism comprises an electrical position transducer.

14. A well system, comprising:

a well completion having a plurality of flow control valves, each flow control valve having a choke adjustable between an open position, a closed position and at least one intermediate position, the plurality of flow control valves being individually controllable via inputs from an electric line and a single hydraulic line, wherein the plurality of flow control valves comprises at least three flow control valves and the choke on each of the at least three flow control valves can be individually positioned at a setting unique with respect to the other flow control valves regardless of the operational position of the other flow control valves.

15. The well system as recited in claim 14, further comprising a plurality of electro-mechanical devices, each electro-mechanical device being coupled to a corresponding flow control valve and to the single hydraulic line, thereby controlling the hydraulic input from the single hydraulic line to the corresponding flow control valve.

16. The well system as recited in claim 15, wherein each electro-mechanical device comprises an electro-hydraulic servo valve.

17. The well system as recited in claim 16, wherein the electro-hydraulic servo valve responds to electrical inputs from the electric line to move between a straight flow and a cross-flow position.

18. The well system as recited in claim 15, wherein each flow control valve comprises an infinitely variable choke.

19. The well system as recited in claim 15, wherein each flow control valve comprises an indexer coupled to the choke.

20. The well system as recited in claim 15, wherein each flow control valve comprises an electrical position transducer coupled to the choke, the electrical position transducer providing feedback as to the actual position of the choke.

21. The well system as recited in claim 14, wherein the plurality of flow control valves comprises at least three flow control valves.

22. The well system as recited in claim 21, wherein the choke on each of the at least three flow control valves is positioned at a setting unique with respect to the other flow control valves.

* * * * *